US005663897A

United States Patent [19]

Geiser

[11] Patent Number: 5,663,897

[45] Date of Patent: Sep. 2, 1997

[54] METHOD AND APPARATUS FOR ANALYZING A SWIMMER'S SWIM STROKE

[75] Inventor: William P. Geiser, Dallas, Tex.

[73] Assignee: Strokz Digital Sports, Inc., Dallas, Tex.

[21] Appl. No.: 479,956

[22] Filed: Jun. 8, 1995

[51] Int. Cl.[6] ..... A63B 31/10

[52] U.S. Cl. ..... 364/550; 441/56; 441/58

[58] Field of Search ..... 364/410, 550, 364/551.01, 561, 565, 569; 434/254; 441/55, 56, 58, 64; 73/379.01–379.05, 865.1, 865.4; 368/107, 69

[56] References Cited

U.S. PATENT DOCUMENTS

| | | | |
|---|---|---|---|
| 3,952,352 | 4/1976 | Wan et al. | 441/64 |
| 4,654,010 | 3/1987 | Havriluk | 434/254 |
| 4,993,004 | 2/1991 | Loizeaux | 368/107 |
| 5,088,072 | 2/1992 | Fitzmorris | 368/69 |

*Primary Examiner*—James P. Trammell
*Assistant Examiner*—M. Kemper
*Attorney, Agent, or Firm*—Warren & Perez

[57] ABSTRACT

A method and apparatus of measuring a swim performance and swim stroke efficiency uses a microcomputer based hand mounted device that can be worn by the swimmer during the swim exercise. The device is secured to a swimmers hand by an adjustable strap and fits roughly within the area defined by the user's fingers. An internal timer and contact switch within the device permit time keeping and stroke counting functions, from which the internal microcomputer derives a plurality of swim performance factors. The device is battery powered and has a "low-battery" indicator to warn the user in advance of total power drain. Swim performance can evaluated via a LCD and a variety of numeric and graphic indicators. The device can be a used by a swimmer to determine swim stroke rate, cycle rate, velocity, distance per stroke and other variables which effect swim performance. The data can be stored in an internal memory means and retrieved later by the user.

14 Claims, 6 Drawing Sheets

METHOD AND APPARATUS FOR ANALYZING A SWIMMER'S SWIM STROKE

TECHNICAL FIELD

The present invention relates in general to an apparatus and method for determining the effectiveness of a swimmer's swim stroke and in particular to a computerized hand mounted instrument designed to measure, analyze and display quantitative information regarding a swimmer's swim stroke.

BACKGROUND OF THE INVENTION

Swimming has long been recognized as one of the most demanding and competitive sports. Over the years, a variety of swimming aids have been developed and used by swimmers during training as part of an aquatic training program. Such aids have been designed to increase swim stroke efficiency and improve stroke technique and power.

Most swimming aids have been developed with the underlying rationale that increased resistance during the swim stroke will result in increased stroke power and therefore improve performance. In essence, performance improves as the swimmer's ability to push water backwards along a line pursued by the swimmer's body increases. Thus, the faster a swimmer can pull his hand through the swim stroke cycle the greater his speed in the water.

Still other swimming aids attempt to improve the swimmer's swim stroke efficiency by developing the swimmer's ability to move water with long, powerful swim strokes to propel the swimmer forward. On the one hand, efficiency depends on a variety of swim techniques such as hand positioning, arm motion, hand pull and body rotation among other factors. On the other hand, factors such as the number of strokes taken as a function of distance, average stroke cycle rate, velocity, and elapsed time also play a big part in defining an efficient swim stroke.

Whether a swimmer desires to improve swim stroke technique or swim stroke efficiency, there are currently no readily available low cost diagnostic and training tools to allow the swimmer to determine, monitor, and analyze swim stroke rate and efficiency.

While state of the art technologies do exist to test and analyze swim performance, such technologies are normally reserved for the elite swimmers who are invited to train or practice at multi-million dollar training centers in preparation for national or international events. Such centers use sophisticated and expensive training equipment including video recorders, computers and enhanced timing systems. Thus, there are no known simple and cost effective diagnostic tools for use by the up and coming athlete in training or for the recreational and fitness swimmer.

Prior devices have been developed and used by swimmers for training and conditioning purposes. For example, U.S. Pat. No. 4,832,643 to Schoofs describes a hand paddle made out of plastic materials or hard rubber which the swimmer can wear on his hands to develop a stronger swim stroke. Another prior art device is described in U.S. Pat. No. 5,147,233 to Hannula wherein a swimming training paddle is described having a textured leading surface which captures water and permits the swimmer to increase swim stroke power.

While these prior art devices are designed to develop swim stroke force and increase power, such devices do not allow the swimmer to gauge his progress by determining a swimmer's stroke rate and stroke time as a function of a particular technique used or distance swam. Until the present invention, the average swimmer was unable to obtain accurate swim stroke time and rate information. Furthermore, until the present invention, the average swimmer had no indication as to whether a particular swim technique was efficient in terms of increasing swim speed and getting the most out of each stroke. A device that allows a swimmer to identify the variable which manufacture swim speed is in great demand.

Thus, there currently is a need for an easy to use and inexpensive device for measuring, analyzing and viewing analytical and quantitative information regarding a swimmer's stroke. There is also a need for such a device that permits the swimmer to determine average swim stroke cycle rates and times as a function of the distance swam. Such a method and device would allow swimmers to gauge their swim stroke and make corresponding adjustments in technique.

Likewise, a need exists for a device that determines the number of strokes taken by a swimmer as a function of distance and elapsed time. Furthermore, there is a need for a device that is inexpensive and available to swimmers of all skill levels and ages. A device that can be mounted to the swimmer's arm, hand or other body part during the swim exercise, but does not interfere with proper swim stroke form or interrupt swim motion during the exercise would fill the hitch left open by prior art training aid and methods.

SUMMARY OF THE INVENTION

Given the void left open by prior art devices and methods, it is a principle object of the present invention to provide a simple and efficient method and device for obtaining quantitative information about a swimmer's swim stroke including stroke rate, cycle time, distance, velocity and other swim performance factors that can be used by the swimmer to analyze swim stroke technique efficiency and performance.

It is another object of the present invention to provide a device that is capable of ascertaining and determining the average rate, number of strokes and distance per stroke during a given exercise, event or distance swam. This is accomplished by a hand mounted device that computes and tracks a swimmer's swim stroke cycle, counts the number of strokes taken by the swimmer in a given distance and determines the total elapsed time.

Yet another object of the present invention to provide a device that is easily mounted to the hand, arm or other body part of a swimmer's body but does not obstruct, impede or affect proper swim stroke, form or efficiency. This is accomplished by a device that combines a plurality of electronic components, in a lightweight box-shaped enclosure which is securely fastened to the swimmer's body by one or more straps.

Stroke count and elapsed time measurements are made with the use of an internal electronic switch and timer which are activated when water force is exerted on a flexible membrane on the device. An internal microcomputer calculates stroke cycle by dividing the elapsed time by the total number of strokes taken by the swimmer. An internal counter keeps track of the number of strokes taken from start to finish corresponding to the time from which water force is first exerted on the membrane to the time when the swimmer depresses an "OFF" button on the device.

From the stroke count and time measurements, an internally kept microprocessor derives a variety of swim performance factors including the swimmer's swim cycle rate, velocity, distance per stroke and Swim Efficiency Index (SEI). These numbers can be stored by the user in any one of a plurality of internal storage registers and recalled later by the user.

A display means is provided in the form of a Liquid Crystal Display (LCD). The LCD allows the user to scroll through a plurality of swim performance factors via one or more function buttons. The LCD is controlled by an internal controller and includes memory for storage of previous swim performance data.

An adjustable strap holds the device in place and firmly on the user's hand. A disc shaped base fits under the third and fourth fingers of the hand to form a harness in which the swimmer's hand fits snugly. Fasteners mounted alongside the instrument enclosure secure the strap to the device and securely to the user's hand.

BRIEF DESCRIPTION OF THE DRAWINGS

Various features of the present invention are pointed out with particularity and the claims annexed to and forming a part of this disclosure. For a better understanding of the invention, its operating advantages and specific objects obtained by its use, reference is made to the accompanying drawings and descriptive matter in which preferred embodiment of the invention are illustrated and in which:

DETAILED DESCRIPTION OF THE PREFERRED EMBODIMENT

Figure 1:
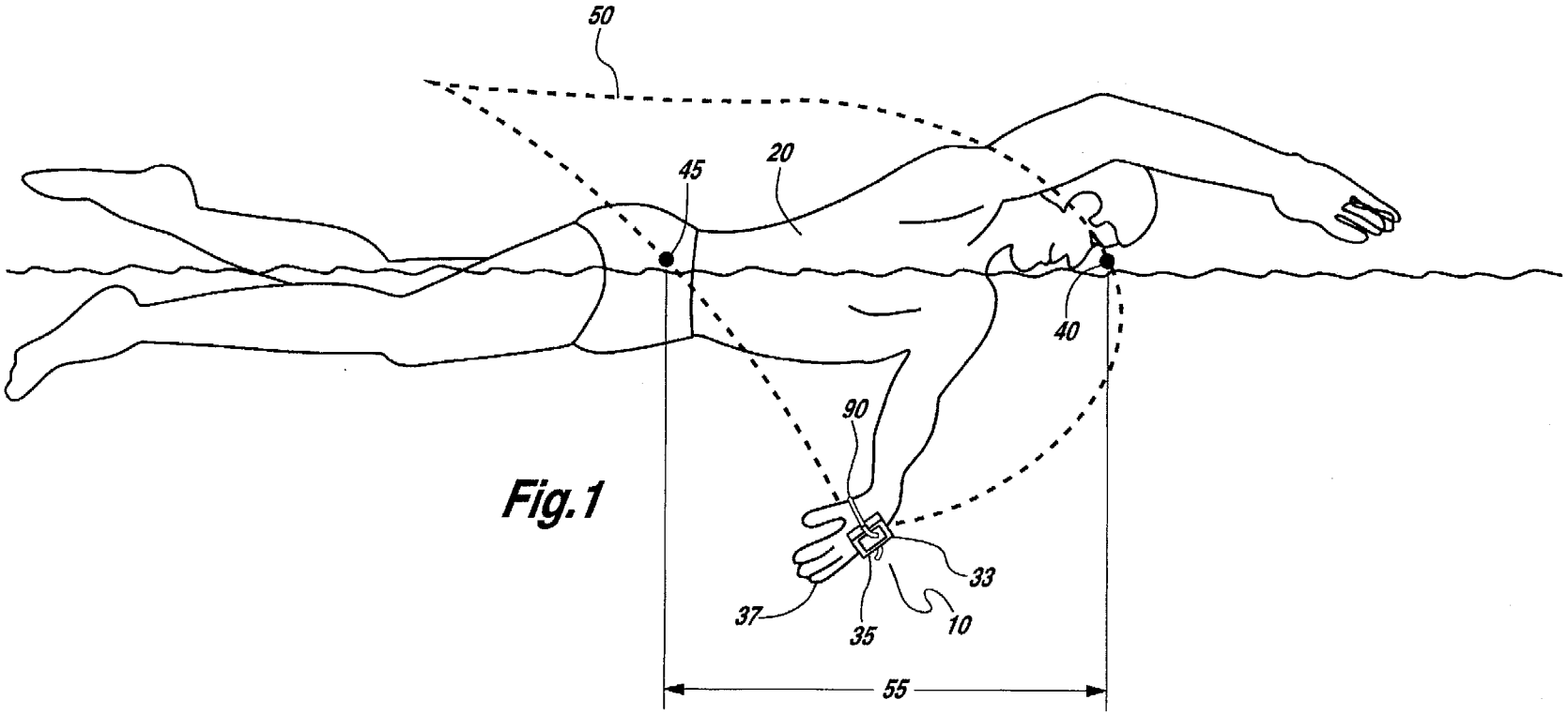
FIG. 1 illustrates typical use of the device in accordance with the preferred embodiment of the present invention.

Reference is now made to the drawings and in particular to FIG. 1 which depicts use of device 35 in accordance with the preferred embodiment of the invention. A shown, device 35 is mounted to a swimmer's hand 37 and carried by the swimmer 20 during swimming. A stroke cycle 50 is followed by the swimmer's hand 37 which carries device 35 along the path defined by stroke cycle 50. Device 35 fits snugly around the swimmer's hand 37 via a strap 90 which ensures device 35 does not come loose or dislodge as hand 37 completes stroke cycle 50. As shown, the hand 37 penetrates the water at entry point 40 and exits at point 45 causing the swimmer 20 to swim a distance 55.

FIG. 1 depicts use of a single device 35 which may be mounted on either hand for operation. It should be readily understood, however, that use of a two separate devices, one on each hand, is within the scope of the present invention and may in some circumstances provide more accurate swim stroke measurements. In another embodiment, device 35 is used in combination with a "dummy" non-operative companion giving the swimmer 20 a sense of balance and uniformity from hand to hand.

Figure 2:
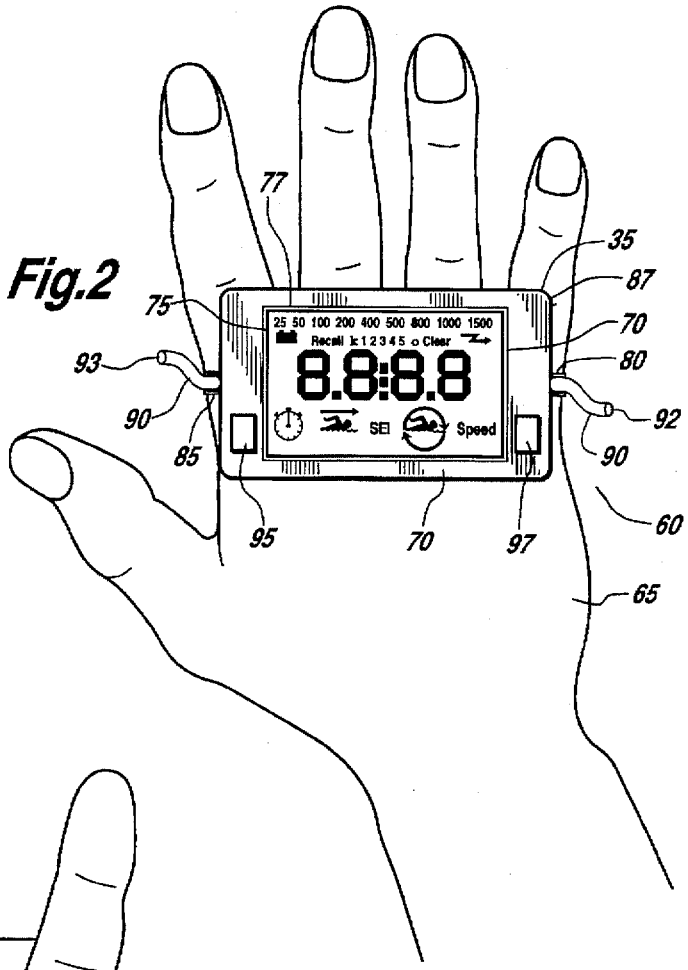
FIG. 2 illustrates the top-side hand view and device placement in accordance with the preferred embodiment of the present invention.

Turning now to FIG. 2, a top side view 60 of the invention in accordance with the preferred embodiment is shown. FIG. 2 shows device 35 situated on a person's hand 65. As shown, the instrument enclosure 70 fits within the area spanned by the average hand width across four fingers eliminate an extension of any part of the device 35 over the hand and limit obstruction with water and other objects. In the preferred embodiment, instrument enclosure 70 measures approximately 3" by 2.5" in dimension, but it should be understood that other dimensions are within the scope of the invention as claimed. In particular, in other embodiments, instrument enclosure 70 comes in several sizes to fit a variety of hand widths such as small, medium or large.

A display means 75 provides the swimmer 20 with visual swim stroke information. Instrument enclosure 70 houses all device 35 components necessary to perform measuring and analysis functions as herein described. Display means 75 is contained within the area defined by instrument enclosure 70 and is flush with surface 77.

Fasteners 80 and 85 are used in conjunction with strap 90 to hold the instrument enclosure 70 firmly on the hand 65. Fasteners 80 and 85 are fixed to instrument enclosure 70 along perimeter 87 to secure strap 90 to hand 65. In the preferred embodiment strap 90 is made of a flexible elastic rubber, surgical tubing or similar material and permits the user to adjust the fit of device 35 by pulling either strap end 92 or strap end 93 through fastener 80 or fastener 85, respectively, until a comfortable snug fit about hand 65 is obtained.

FIG. 2 also shows that function buttons 95 and 97 are accessible from instrument surface 77 of instrument enclosure 70 allowing the user to select the various options and modes of operation as herein described.

Figure 3:
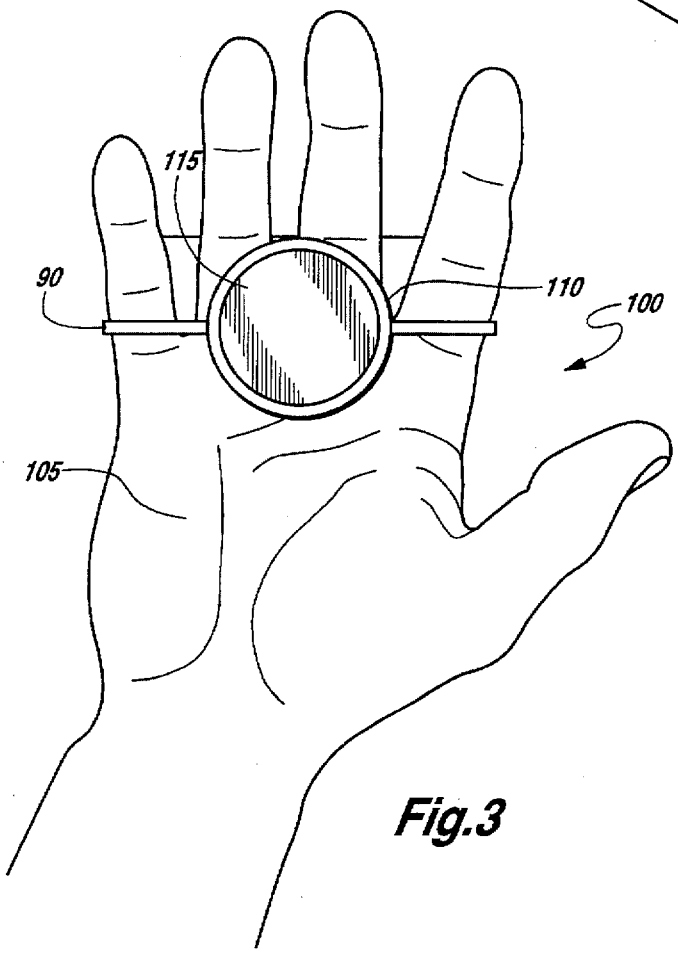
FIG. 3 illustrates the bottom-side hand view and device placement in accordance with the preferred embodiment of the present invention.
Figure 4:
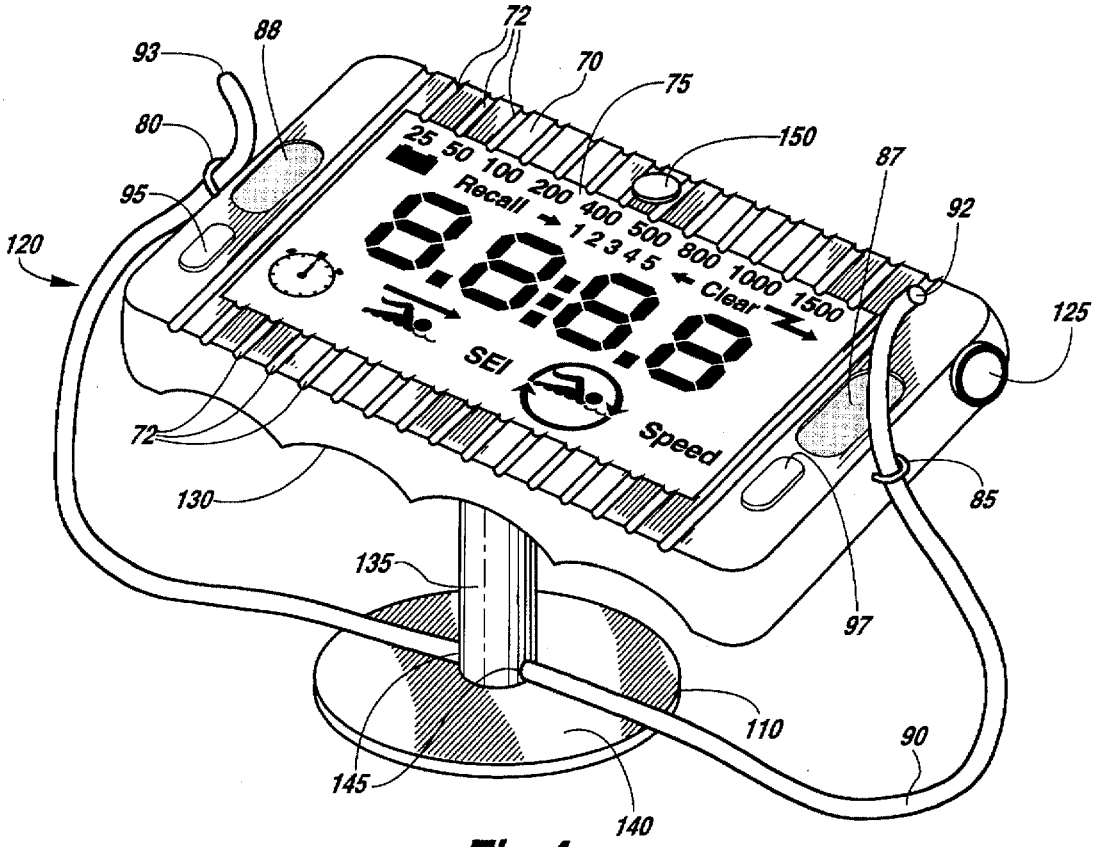
FIG. 4 is a detailed perspective showing physical characteristics of the preferred embodiment of the present invention.

Turning now to FIG. 3, a bottom side palm view 100 of the device 35 in accordance with the preferred embodiment of the invention is shown. Strap 90 extends as shown around palm 105 to securely fasten the device 35 on the hand 65. A retainer 110 which holds the device 35 in place and forms an outer perimeter around disc shaped membrane 115. In the preferred embodiment, membrane 115 comprises a flexible yet watertight surface which moves inward as water force is exerted and retracts to its original position as the force is relieved.

The physical characteristics of the device 35 are more easily appreciated with reference to FIG. 3 which is a detailed perspective view 120 of the device 35. Instrument enclosure 70 forms a substantially rectangular shaped box for housing the internal microcomputer, power cell, memory means, control circuits and other instrument components. In the preferred embodiment instrument enclosure 70 is made of a lightweight waterproof material such as acrylic, polyurethane or other similar material capable of withstanding chlorine and other chemicals found in the water.

As shown, device 35 can be shaped to conform to a person's hand by using a series of finger shaped grooves 132 along bottom 130. Fasteners 80 and 85 extend from instrument enclosure 70 to hold strap 90 in place when adjusted by the user. Strap 90 is inserted first through fastener 80 and opening 145 of stem 135 and finally through fastener 85. Strap end 92 and strap end 93 may be pulled to adjust strap 90 and achieve a desired length and fitting about a user's hand.

Flow grooves, 72 are formed on surface 77 to provide a series of water conduits for increasing water flow across the device 35 as it is pulled though the water. Flexible membrane structures 87 and 88 extend from surface 77 and act to relieve internal pressure created when water force is exerted on disc shaped membrane 115 to allow the device 35 to perform stroke measurement functions to commence.

Stem 135 connects base 140 to instrument enclosure 70 at bottom 130. As should be understood by one of ordinary skill, strap 90, instrument enclosure 70, bottom 130, grooves 132 and base 140 together form a sturdy harness into which the hand may be inserted. Strap 90, bottom 130 and base 140 ensure device 35 stays fastened to the hand 65 throughout stroke cycle 50.

Also shown function button 95 and function button 97 are provided to select ON/OFF, START/STOP, select mode, display results and other device functions and features. In one embodiment, an infrared signal interface 150 is provided allowing stroke measurement and analysis results to be downloaded to a separate storage or processing means. A cell cap 125 screws into enclosure 70 and may be removed by the user to expose a replaceable power cell.

Figure 5:
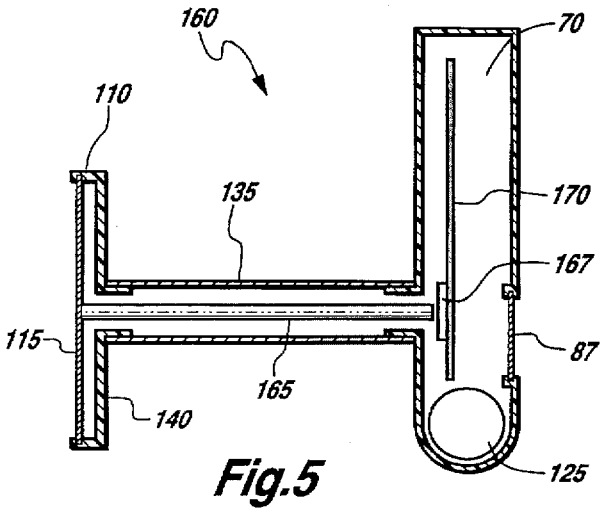
FIG. 5 is a cross-sectional view of the contact switch mechanism in accordance with the preferred embodiment of the present invention.

Turning now to FIG. 5, a cross sectional view of the device 35 and in particular the contact switch 160 used in conjunction with the preferred embodiment of the present invention is shown. Retainer 110 forms a circular housing at base 140 which maintains flexible membrane 115 in place. A force exerted on membrane 115 causes circuit 165 to be moved towards contact 167 on printed circuit board (PCB) 170. In operation, a water force exerted on membrane 115 initiates swim stroke measurement and analysis functions by causing circuit 165 to touch contact 167.

In the preferred embodiment membrane 115 moves in response to a water force being exerted as a swimmer's hand 37 is pulled through stroke cycle 50. Circuit 165 and contact 167 are made of a conductive type metallic material which forms a complete circuit path. Membrane structures 87 and 88 are made of a similar flexible material as membrane 115 and act to relieve pressure within enclosure 70 as force is exerted on membrane 115. Likewise, membrane structures 87 and 88 assume their original surface 77 level position when water force on membrane 115 is relieved.

Figure 6:
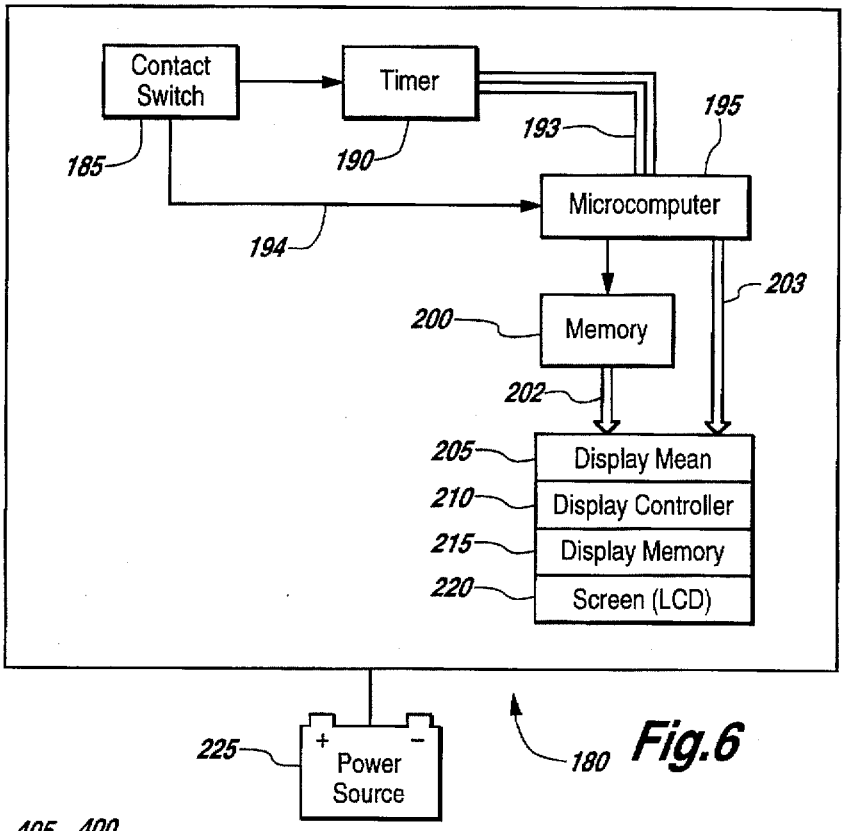
FIG. 6 is an overall component block diagram in accordance with the preferred embodiment of the present invention.

Turning now to FIG. 6, a block diagram 180 illustrating the various components used in conjunction with the preferred embodiment of the present invention is shown. A contact switch 185 initiates all device 35 functions when water force is sensed on membrane 115. Contact switch 185 causes timers 190 to be reset in preparation for time and stroke measuring functions.

A microcomputer 195 receives time data information from timer 190 via communications path 193. Contact switch 185 also initiates microcomputer 195 via signal path 194. Microcomputer 195 performs the measurement and analysis functions of the device 35 and may comprise any one of readily available microcontrollers or microprocessors on the market today. Alternatively, microcomputer 195 may be partially or wholly implemented in an analog circuit arrangement which maintains a stroke count by aggregating the number of times membrane 115 moves forward to initiate device 35 functions.

Microcomputer 195 maintains an elapsed time for a particular distance swam and counts the total number of strokes from the time device 35 functions are initiated to when the user depresses a STOP button on the device 35. Results are stored in memory 200 such as a non-volatile memory or conventional random access memory (RAM).

A display means 205 is provided to show results to the user. In the preferred embodiment, display means 205 comprises a display controller 210, display memory 215 and screen 220 such as a Liquid Crystal Display (LCD). Display controller 210 receives time and stroke information from microcomputer 195 or memory 200 via communication paths 203 and 202, respectively. Display controller 210 drives screen 220 causing numeric information corresponding to various swim stroke measurements. Display memory 215 is used to store multiple event performance factors and allow the user to recall prior swim performance factors corresponding to a particular event or distance swam in the past.

A source 225 supplies power to all components and in the preferred embodiment is one or more replaceable cell type batteries such as a Ni-kad or lithium based cell battery readily available in the market.

Figure 7:
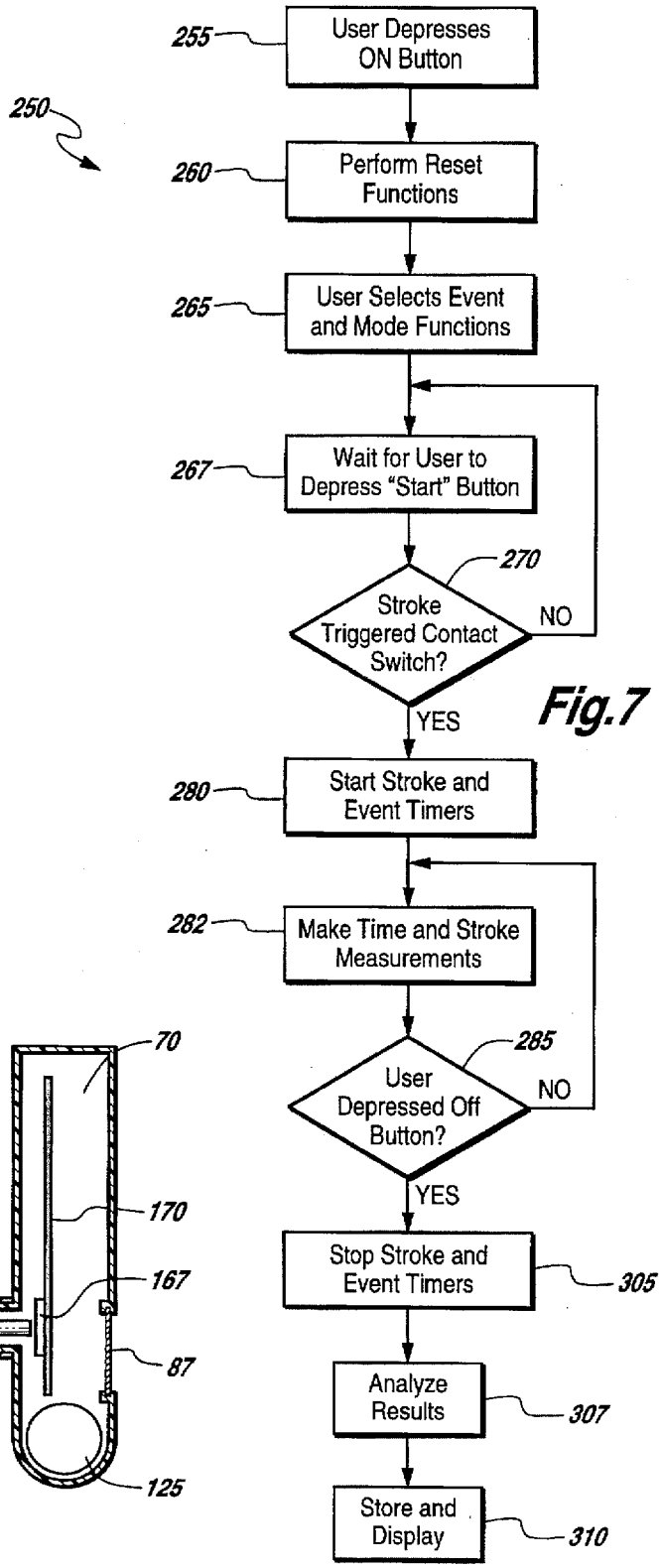
FIG. 7 is a process flow diagram of the method used to measure swim performance in accordance with the preferred embodiment of the present invention.

Turning now to FIG. 7, the process 250 used to measure and analyze swim performance is depicted in greater detail. A user initiates the process 250 by depressing an "ON" button 255 on device 35 which causes a reset 260 of all device functions in preparation for swim stroke measurements. Next, a user selects event and mode options 255 via function buttons 95 and 97. For example, in step 255 the user has the option of selecting a particular distance to swim, recall swim performance results from a previous event or clear results from a previous event, and other possibilities. At this point 267, device 35 is ready to take swim stroke measurements.

Next, process flow is directed to step 270 where the device 35 is waiting for a water force to trigger contact switch 160 by exerting a suitable amount of force on flexible membrane 115. Once circuit 165 touches contact 167, stroke and elapsed time counters are started 280 marking the beginning of an event. Stroke measurement are made 282 which involves incrementing an internal stroke counter for each instance of water force on membrane 115. Step 282 involves counting the number of times the hand 37 enters a sufficient depth of water to cause a water force to be exerted on membrane 115.

Measurements 282 continues until a user depresses an "OFF" button 285 on device 35 such as function button 95 or function button 97. Once the user depresses the "OFF" button, the internal stroke and elapsed time counters stop 305 wherein the internal microprocessor 195 calculates and analyzes 307 plurality of swim performance factors. Finally, in step 310 the results are stored and displayed to the user 310.

Figure 8:
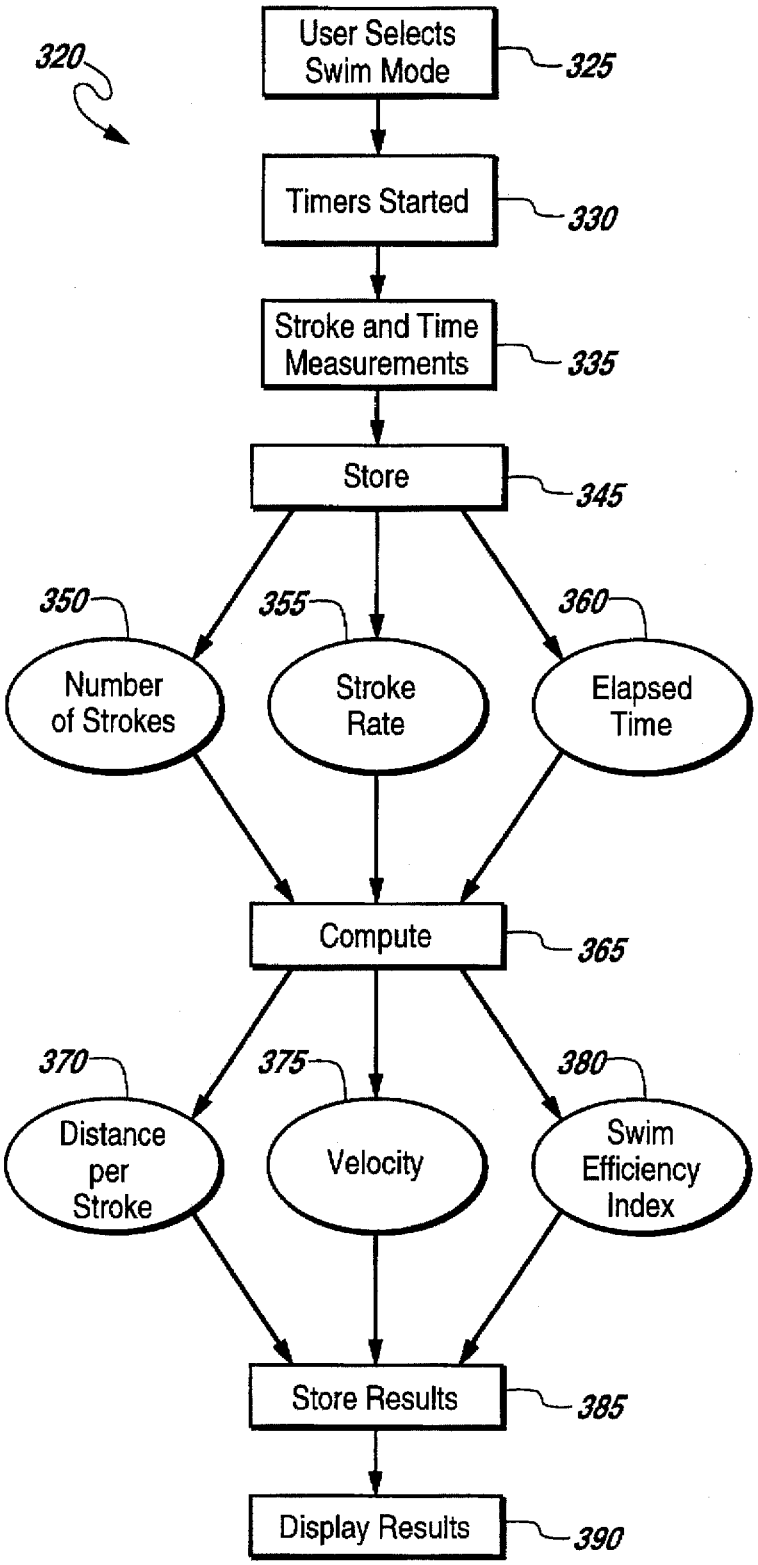
FIG. 8 is a flow diagram illustrating the analysis and results obtained in accordance with the preferred embodiment of the present invention.

Reference is now made to FIG. 8 which illustrates the various analysis results 320 generated by device 35 after use by a swimmer in accordance with the preferred embodiment of the invention. A user selects a swim mode 325 such as the distance to swim causing internal counters within the device to be activated 330. In the preferred embodiment, the user may select various distances to swim 325. Stroke count and elapsed time measurements 335 are made according to the process herein described and stored 345 to keep a record of the number of strokes 350 and total elapsed time 360 in order to compute a stroke rate 355.

As shown, a plurality of various swim performance factors are computed 365 including the distance per stroke 370, swim velocity 375 and swim efficiency index (SEI) 380. The SEI 380, as contemplated by the present invention, is an indication of the number of strokes taken added to the number of strokes (in seconds) and divided by the total distance swam. Thus the higher an SEI 380, the less efficient a particular swimmer is as compared to other swimmers or as the swim distance increases. Also, the SEI 380 gives a particular swimmer an indication of how his or her efficiency is effected by the distance swam.

Process flow continues to storing results 385 in an internal memory space 200 prior to displaying the results 390 via display means 205.

Figure 9:
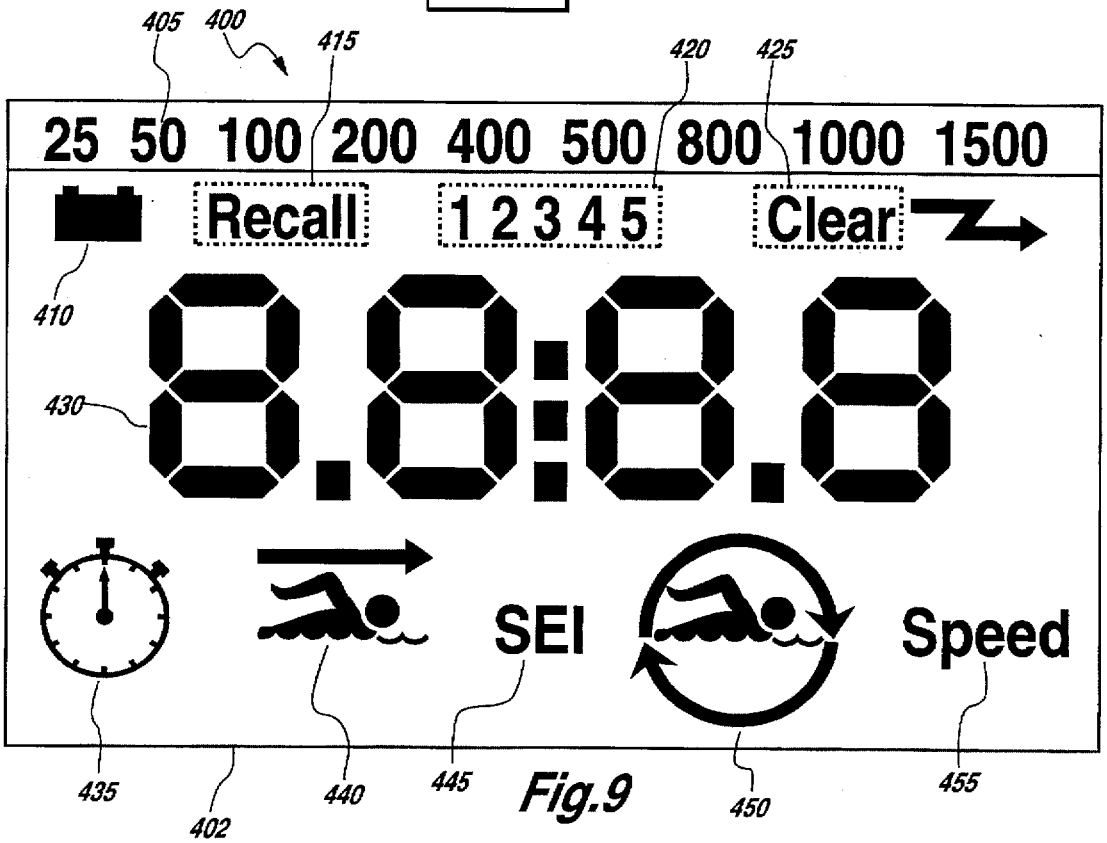
FIG. 9 is an illustration of the screen display in accordance with the preferred embodiment of the present invention.

The screen interface and arrangement of screen display indicators shown to a user on the screen display 220 can be more fully appreciated by reference to FIG. 9. FIG. 9 illustrates the screen display 400 in accordance with the preferred embodiment of the invention. As shown, screen display 400 has a distance indication section 405 to allow the user to select a distance to swim with function buttons 95 or 97. Distance indicators 405 range from 25 to 1500 and may be displayed in yards, meters or other accepted standard of measurement.

Charge indicator 410 notifies the user when power levels are low by blinking or highlighting in a manner that warns the user and provides the user sufficient time to change battery cells 225 when they are low. Recall indicator 415 allows the user to select and review a stored event with event marker 420. Clear event indicator 425 is provided to allow the user to delete a stored event. Numeric indicators 430 gives a readout of the presently selected swim performance factor which the user may view and scroll through by use of function buttons 95 or 97.

Also shown are the various swim performance factors which a user may scroll and select for readout via numeric indicators 430 on display screen 400. These include elapsed time indicator 435, distance per stroke indicator 440, SEI indicator 445, swim cycle rate indicator 450 and velocity indicator 455. As contemplated by the present invention, numeric indicators 430 correspond to the particular swim performance factor 435, 440, 445, 450 and 455, and are highlighted by the user through function buttons 95 or 97, thus allowing the user to scroll through the various analysis results.

Modifications of this invention will occur to those skilled in the art. Therefore, it should be understood that this invention is not limited to a particular device or process disclosed, but that the specification is intended to cover all such modifications which are within the true spirit and scope of this invention as claimed.

What is claimed is:

1. A device for analyzing a swimmer's swim stroke comprising:

an enclosure forming a substantially rectangular shaped housing with a top, a bottom and at least two ends;

first and second fasteners attached to said ends of said enclosure;

a stem extending from said bottom of said enclosure and connecting said enclosure to a base member, said base member having a retainer about its perimeter that secures a flexible membrane;

a printed circuit board within said enclosure and having an on-board microprocessor preprogrammed to determine a plurality of swim performance factors, a metallic contact and a timer;

display fixed to said top of said enclosure;

communications pathway coupling said microprocessor to said display;

a circuit lead within said stem and having a length that extends substantially from said flexible membrane to said printed circuit board and spatially arranged to move inside the stem when water force is exerted on said flexible membrane so as to touch said metallic contact and cause said microprocessor to perform a plurality of swim analysis calculations.

2. The device according to claim 1 wherein said display is a liquid crystal display.

3. The device according to claim 1 further including a plurality of grooves formed on said top of said enclosure.

4. The device according to claim 1 wherein the enclosure is made of a waterproof chlorine resistant material.

5. The device according to claim 1 further comprising function buttons positioned on the top of the enclosure for controlling the operation of said microprocessor.

6. A device for measuring, analyzing and displaying swim performance comprising:

an instrument enclosure having a substantially box-shaped configuration;

first and a second fasteners attached to opposite ends of the instrument enclosure;

a plurality of instrument components including a microprocessor and a timer contained within the instrument enclosure;

a base;

a stem connecting the base to the instrument enclosure;

a flexible membrane attached to the base;

a retainer forming a perimeter around the base for holding the membrane; and a circuit lead inside the stem and having a length extending from the membrane to the enclosure, said lead arranged to move inside the steam in response to a force being exerted on the membrane thereby causing the microprocessor to perform a plurality of measuring and analyzing functions.

7. The device according to claim 6 further comprising:

a display means comprising a display controller, display memory and a screen, the display means communicably linked to the microprocessor; and a communications pathway linking the microprocessor to the timer for receiving time information.

8. The device according to claim 6 further comprising;

an opening in the stem near the base;

a strap inserted through the opening and having first and second ends extending through the said first and second fasteners of the instrument enclosure; and first and second flexible membrane structures extending from the top of the enclosure.

9. The device according to claim 6 further comprising:

a plurality of grooves on the surface of the instrument enclosure for directing water flow;

a plurality of finger shaped grooves on the bottom of the instrument enclosure; and a cell cap screwed to the instrument enclosure.

10. The device according to claim 6 wherein the instrument enclosure is made of a waterproof chlorine resistant material.

11. The device according to claim 6 wherein the microcomputer is programmed to compute a plurality of swim performance factors including stroke rate, elapsed time, velocity, number of strokes and a swim efficiency index.

12. A waterproof microprocessor-based swim tool for determining a swimmer's swim stroke, total elapsed time and swim stroke efficiency comprising:

a substantially boxed-shaped instrument enclosure having a top surface with a plurality of water grooves formed thereon, a bottom surface that is groove shaped to fit a human hand and fasteners attached to opposite ends of the enclosure;

a stem extending from the enclosure and ending in a substantially rounded base member having a retainer about its perimeter, said retainer supporting a flexible membrane member that extends into the base member in response to a water force;

a circuit lead that extends inside the stem a length approximately extending from the membrane to the enclosure; and a printed circuit board within the enclosure having at least a power cell, a microprocessor, a timer, display electronics and a contact, said contact arranged on the printed board to touch the circuit lead at times when a water force is exerted in the membrane thus causing an interrupt signal to be transmitted to the microprocessor thereby causing the microprocessor to initiate a plurality of swim performance calculations.

13. The device according to claim 12 further including:

a liquid crystal display affixed to the top surface of the enclosure and electronically coupled to the display electronics on the printed circuit board; and a plurality of functions buttons affixed to the enclosure for controlling microprocessor and display functions.

14. The device according to claim 12 wherein said stem has an opening near the base member and further including an adjustable strap that extends from one fastener through said stem opening and to another fastener for securing the device to a swimmer's hand.

* * * * *